US009186769B2

(12) United States Patent
Moncrieff

(10) Patent No.: US 9,186,769 B2
(45) Date of Patent: Nov. 17, 2015

(54) PROFILING DEVICE

(76) Inventor: Troy Moncrieff, Bundall (AU)

( * ) Notice: Subject to any disclaimer, the term of this patent is extended or adjusted under 35 U.S.C. 154(b) by 30 days.

(21) Appl. No.: 14/233,825

(22) PCT Filed: Jul. 20, 2012

(86) PCT No.: PCT/AU2012/000872
§ 371 (c)(1),
(2), (4) Date: May 6, 2014

(87) PCT Pub. No.: WO2013/010227
PCT Pub. Date: Jan. 24, 2013

(65) Prior Publication Data

US 2014/0302758 A1 Oct. 9, 2014

(30) Foreign Application Priority Data

Jul. 20, 2011 (AU) ..... 2011902912

(51) Int. Cl.
*B24B 23/02* (2006.01)
*B24B 23/00* (2006.01)
*B26B 29/00* (2006.01)
*B24B 9/06* (2006.01)

(52) U.S. Cl.
CPC ..... *B24B 23/005* (2013.01); *B24B 9/06* (2013.01); *B24B 23/028* (2013.01); *B26B 29/00* (2013.01)

(58) Field of Classification Search
CPC ..... B24B 23/02; B24B 23/028; B24B 41/04; B24B 55/052; B25F 5/02
USPC ..... 451/438, 439, 241, 545, 549, 358, 359
See application file for complete search history.

(56) References Cited

U.S. PATENT DOCUMENTS

| | | | | | |
|---|---|---|---|---|---|
| 1,129,310 | A | * | 2/1915 | Platt | 30/2 |
| 2,635,655 | A | * | 4/1953 | Linstead | 144/134.1 |
| 2,681,531 | A | * | 6/1954 | Mastrone | 451/241 |
| 5,371,977 | A | * | 12/1994 | Liner | 451/349 |
| 5,697,833 | A | * | 12/1997 | Hislop | 451/344 |
| 5,815,932 | A | * | 10/1998 | Presher et al. | 30/373 |

(Continued)

FOREIGN PATENT DOCUMENTS

| | | |
|---|---|---|
| DE | 10139256 | 2/2003 |
| JP | 62-32707 U | 2/1987 |
| WO | 2006/053138 A2 | 5/2006 |

OTHER PUBLICATIONS

International Search Report for corresponding patent application No. PCT/AU2012/000872 dated Nov. 19, 2012.

(Continued)

*Primary Examiner* — George Nguyen
(74) *Attorney, Agent, or Firm* — Renner, Otto, Boisselle & Sklar, LLP

(57) ABSTRACT

A profiling device (100) is discussed, the profiling device is adapted for mounting to a cutting implement such as an angle grinder (10) having body (11), head (12), blade (13) and guard (14). The profiling device (100) preferably includes an elongate member (101) which encapsulates a portion of the blade (13) and a shroud (102) which is secured to the head (12) end of the grinder (10). The elongate member (101) includes rails (1011, 1012) which act as a cutting guide for the cutting implement to produce the desired profile to the work piece. Rails (1011, 1012) are preferably disposed at a pre-set angle? to one another with the portion of the blade (13) accommodated therein.

23 Claims, 12 Drawing Sheets

(56) References Cited

U.S. PATENT DOCUMENTS

| | | | | |
|---|---|---|---|---|
| 6,588,111 | B2 * | 7/2003 | Williams | 30/391 |
| 6,702,659 | B1 * | 3/2004 | Moncrieff et al. | 451/358 |
| D505,737 | S * | 5/2005 | Beranek et al. | D25/199 |
| 7,029,212 | B2 * | 4/2006 | Adkins et al. | 409/180 |
| 7,198,042 | B2 * | 4/2007 | Harris | 125/13.01 |
| 7,596,872 | B2 * | 10/2009 | Clarke et al. | 30/391 |
| 7,891,101 | B2 * | 2/2011 | Brady | 30/371 |
| 8,365,419 | B2 * | 2/2013 | Bernardi et al. | 30/371 |

OTHER PUBLICATIONS

International Report on Patentability for corresponding patent application No. PCT/AU2012/000872 dated Jan. 21, 2014.

* cited by examiner

PROFILING DEVICE

This application is a national phase of International Application No. PCT/AU2012/000872 filed Jul. 20, 2012 and published in the English language.

BACKGROUND OF THE INVENTION

1. Field of the Invention

The present invention relates to a device to assist in the profiling and/or cutting of vitreous and/or porous materials such as ceramics. In particular although not exclusively the present invention is directed to a device for profiling or cutting of ceramic and glass tiles.

2. Discussion of the Background Art

Tiles are often used to form wall and floor coverings, and can range from simple square tiles to complex mosaics. Tiles are most often made from porcelain, fired clay or ceramic with a hard glaze, but other materials are also commonly used, such as glass and stone. Generally it is the hard wearing nature along with general water resistance that has seen the use of tiles in many wet and high traffic areas of buildings such as bathrooms, lobbies, foyers, atriums, kitchens etc.

As tiles come in various shapes and sizes it is often necessary to cut tiles to length in order to fit them within the dimensions of the area in which they are installed. Often a number of angled cuts are required to ensure that tiles are properly fitted into and around corners and various fixtures and fittings within the installation area. One of the simplest devices available for cutting tiles are beam score cutters. Essentially these devices make use of the fact that while tiles are hardwearing they are also brittle and prone to breakage along faults such as cracks etc within the tile. Such beam cutters are equipped with a scoring blade which is used to score the tile where the cut is to be made. Once the tile is scored pressure is exerted on the tile about the scored section to cause the tile to fracture along the score. Often this results in a clean break of the tile in case where it does not the stray pieces of tile are removed using tile nippers.

While beam cutters and the like are useful for making cuts their application is somewhat limited. Such device are typically limited to making straight cuts moreover they are effective for certain tile thicknesses. To perform more complex angle cuts and to effect cutting of tiles of greater thicknesses tile saws are often utilised. Such saws often include a table or stand which supports an electric saw, the table or stand may also include a cutting guide to guide the tile in relative to the blade. While such saw provide for accurate cuts at a variety of angles their size and weight and expense makes them less than appeal to the average tradesman or home handy man where the expense and transportation of such a saw is not feasible for small jobs.

An alternative to the tile saw is the use of a angle grinder fitted with a diamond blade. Such blades are relatively inexpensive and fit most models of grinders. This relatively simple arrangement enables most handy men and trades people to cut tiles utilising an existing tool they already own. However the problem with using a grinder fitted with such a blade is that it often difficult to obtain a precise cut. Often an angled cut or bevel with this arrangement are often made by eye as most commercially available angle grinders do not come with cutting guides.

On example of a device to assist in the cutting of tiles or the like utilising a grinder is discussed in International Application No WO 2000/48799 to Moncrieff entitled "profiling tool" (hereinafter the '799 reference). The device of the '799 reference includes an elongate member having a slot, a first and second arms disposed at opposing ends of the elongate member. The device is affixed to an angle grinder by the arms, with the first arm being attached to one side of the casing of the angle grinder, and the second arm being attached to the other side of the casing of the angle grinder by a casing bolt such that the blade of the angle grinder passes through the slot. As the arrangement of the '799 reference requires attachment to grinder's casing by means of casing bolts it is application is limited to a number of older angle grinder models.

Clearly it would be advantageous to provide a device to assist in the cutting of tiles or the like which fitted to a wide variety of cutting devices in a safe and effective manner.

SUMMARY OF THE INVENTION

Disclosure of the Invention

Accordingly in one aspect of the present invention there is provided a profiling device for attachment to a cutting device including a cutting implement the profiling device including:

- an elongate member adapted to accommodate a portion of the cutting implement said elongate member including first and second rail members wherein the first rail member is angularly disposed to the second rail member;
- should coupled to the elongate member for attachment to the cutting device;
- wherein the shroud is secured to the cutting device adjacent the cutting implement such that a portion of.

Suitably the shroud is clamped to the cutting device, for example the shroud could be clamped on a portion of the cutting device's cutting guard, body or head. In one embodiment of the present invention the shroud could be a two piece construction having a pair of segments for engagement with the cutting device or cutting guard. In such instances the shroud could be secured to the cutting device or guard by drawing adjacent end of the segments together clamping the shroud on the relevant portion of the cutting device. Preferably the segments of the shroud are drawn together via a faster inserted through lugs positioned on the outer periphery of each segment.

In one embodiment of the present invention the shroud could a unitary body which is secured to the cutting device by a pair of clamping members which are secured to the shroud. The clamping members could secured to the shroud via threaded engagement. Preferably the shroud is of a semicircular construction with the clamping members being diametrically opposed. The clamping members may have any suitable cross section to permit them to grip a portion of the cutting device to effect attachment of the shroud. For example the clamping members may have a substantially L shaped cross section.

In yet another embodiment of the present invention the clamping members could pivotally mounted on the elongate. In such instances the clamping members could be movable between a locked and open position. Preferably the clamping members are designed to engage a portion of the shroud and cutting device when in the locked position to facilitate the attachment of the shroud to the cutting device. The clamping members may be any suitable shape to grip of the shroud and cutting device when in the locked position for example the clamping members could be substantially U shaped.

Suitably the angular displacement between the first and second rail member is set to accommodate standard angular cuts such as a mitre, bevel or champer. For instance the angle between the rail members could be between 5° to 10°, 10° to 15°, 20° to 30° or 45°.

Preferably the elongate member includes a slot for accommodating the portion of the cutting implement. The slot may be disposed adjacent the join between the first and second rail members.

In one embodiment of the invention the elongate member may be removably securable to shroud allowing elongate members having different angular displacement between the rail member to be interchanged. Such attachment could be via a snap lock fitting or screw fitting or the like. Alternatively the first rail member could be pivotally or hinged mounted to the second rail member allowing the angle between the two rails to be adjusted between a number of discrete positions. In such instances the angular variation between the rails could be set utilising a guide secured to the elongate member.

A spacer may be provided for use with the profiling device of the present invention. Suitably the spacer is positioned between the shroud and the cutting device. The spacer may included a pair of arms connected via a compressible structure. Preferably the spacer is of a generally semicircular construction with a series of flanges extending outwardly at discrete points on the outer periphery of the spacer for insertion into one or more cut outs disposed in the shroud. The flanges may include one or more shoulder portions for engagement with the interior surface of the shroud. The shoulder portions may be formed from a set of projections extending from the face of the spacer. The projections may be varied in height to suit a particular model of cutting device. The arms may be shaped to suit a particular model of cutting device.

BRIEF DETAILS OF THE DRAWINGS

In order that this invention may be more readily understood and put into practical effect, reference will now be made to the accompanying drawings, which illustrate preferred embodiments of the invention, and wherein.

Figure 5:
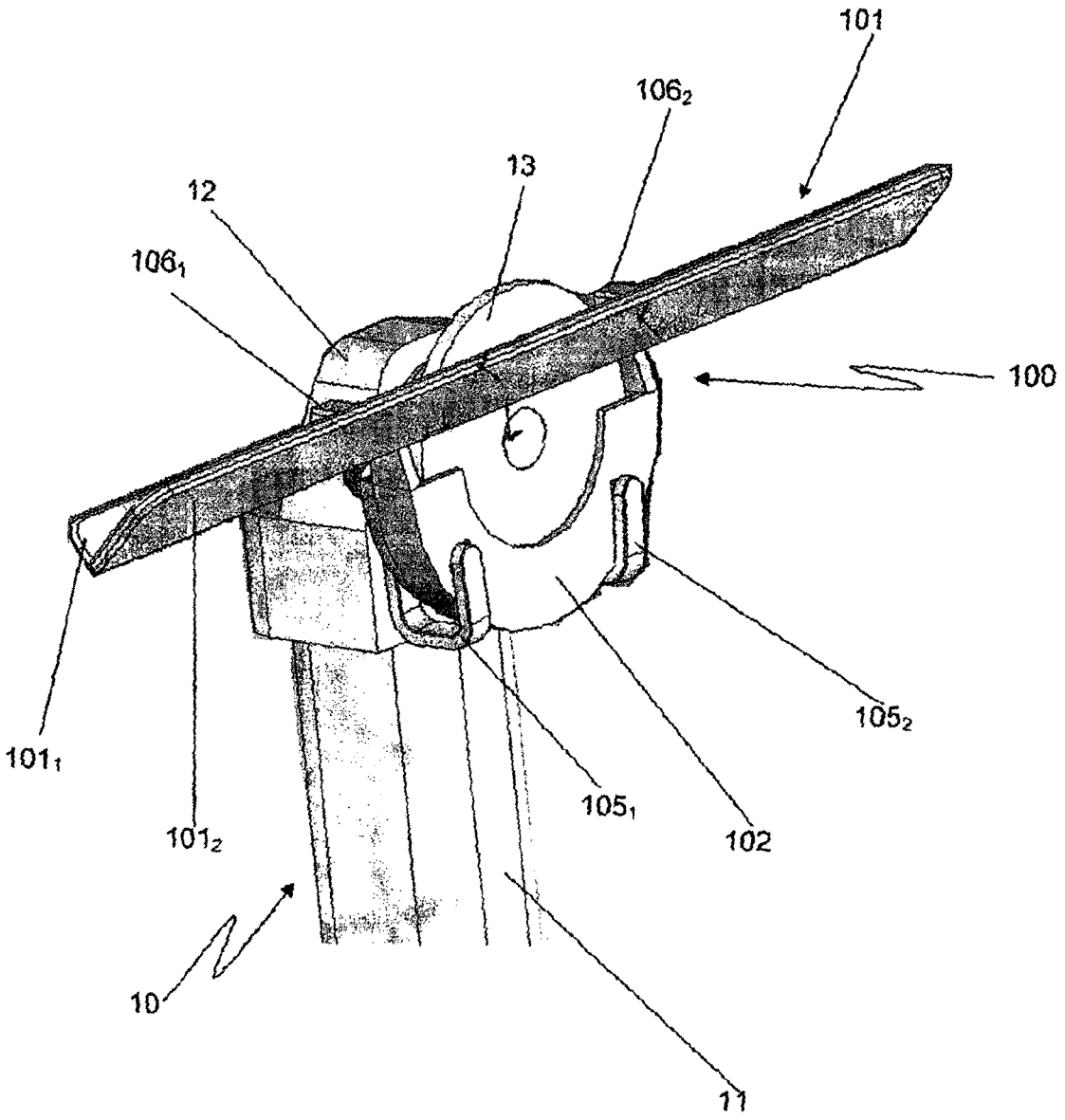
Figure 6:
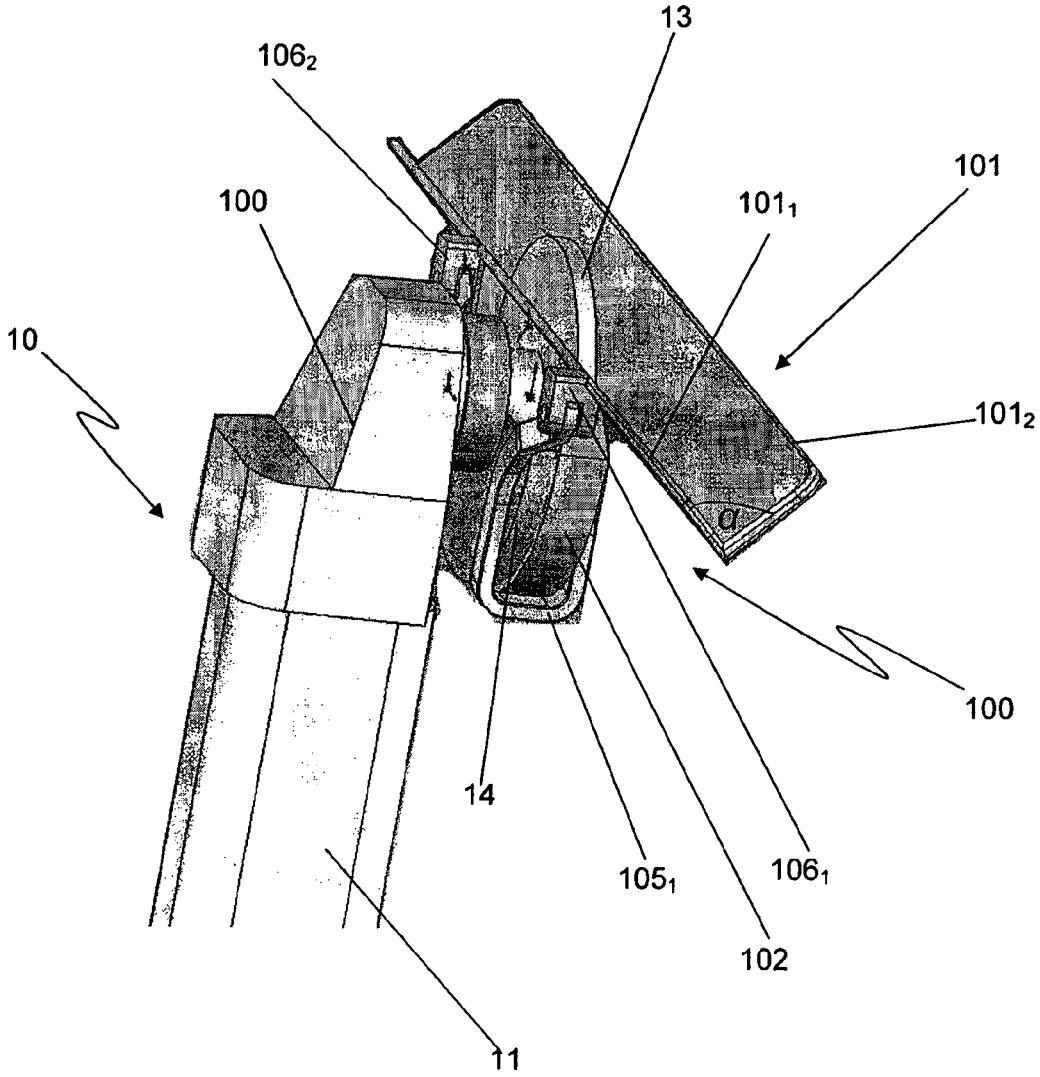
Figure 7:
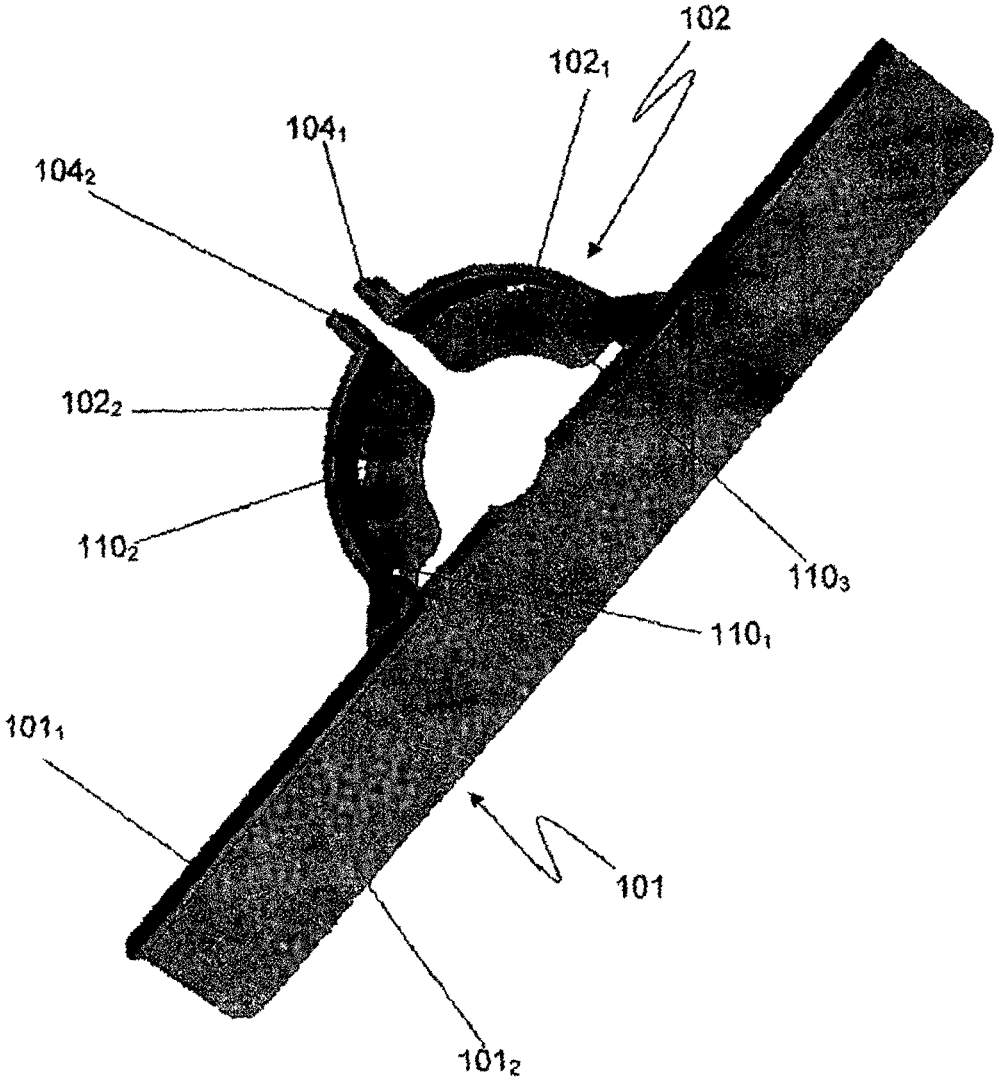
Figure 8A:
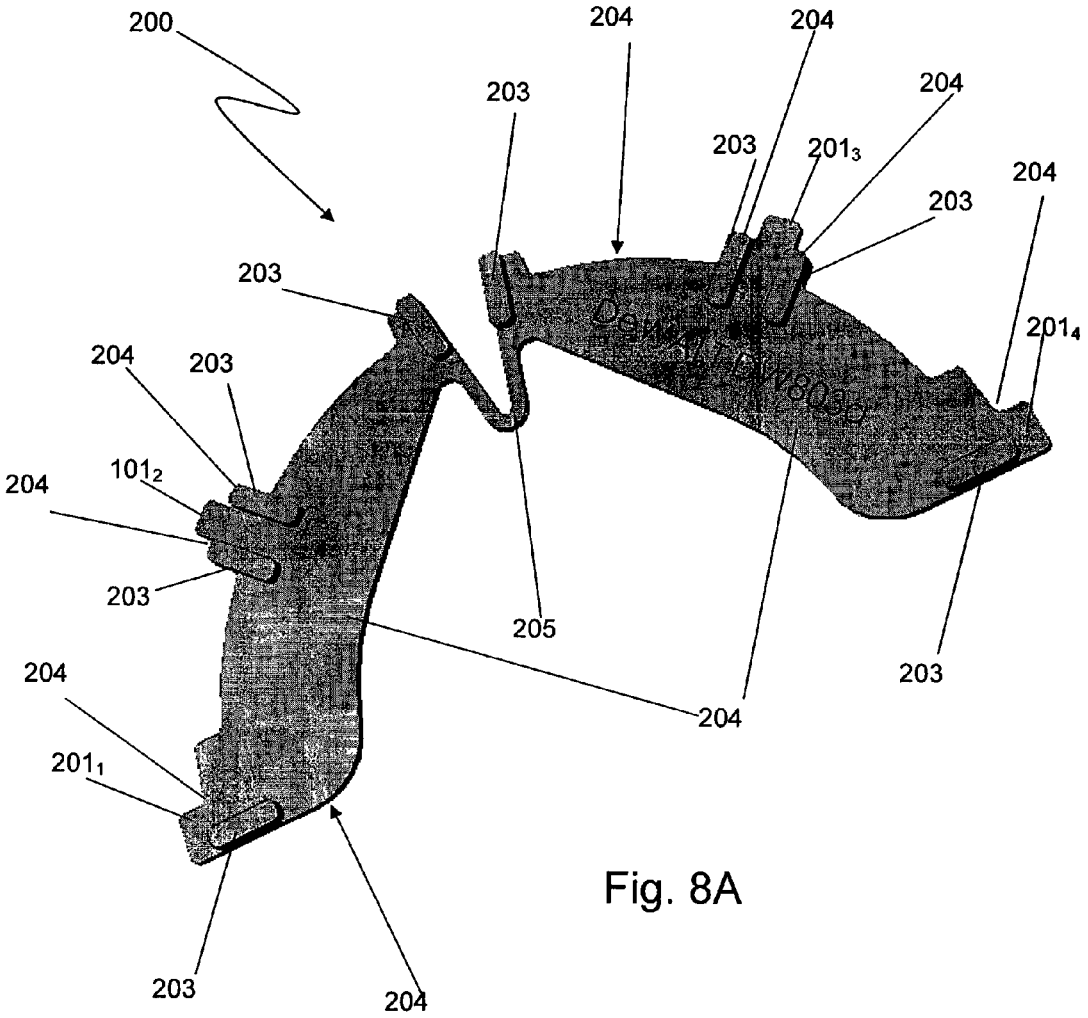
Figure 8B:
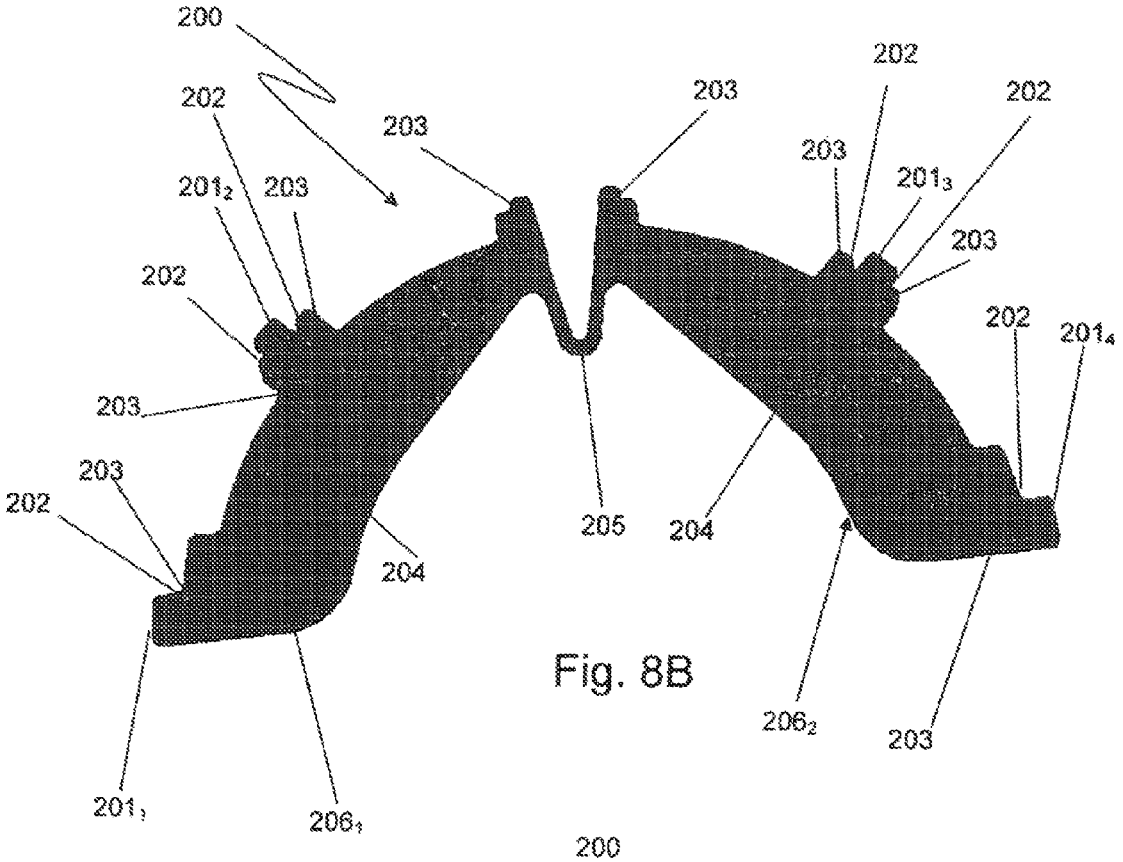
Figure 8C:
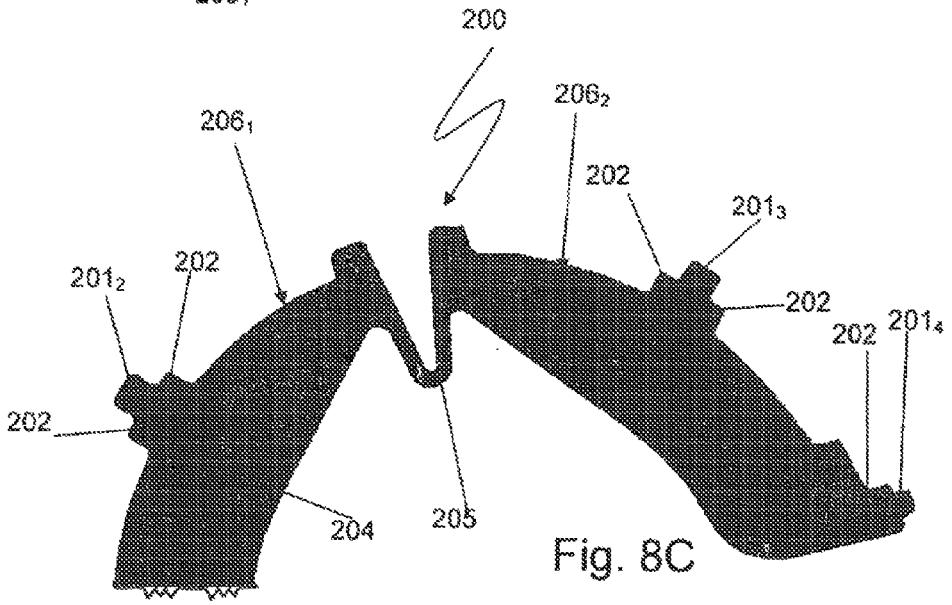
Figure 9:
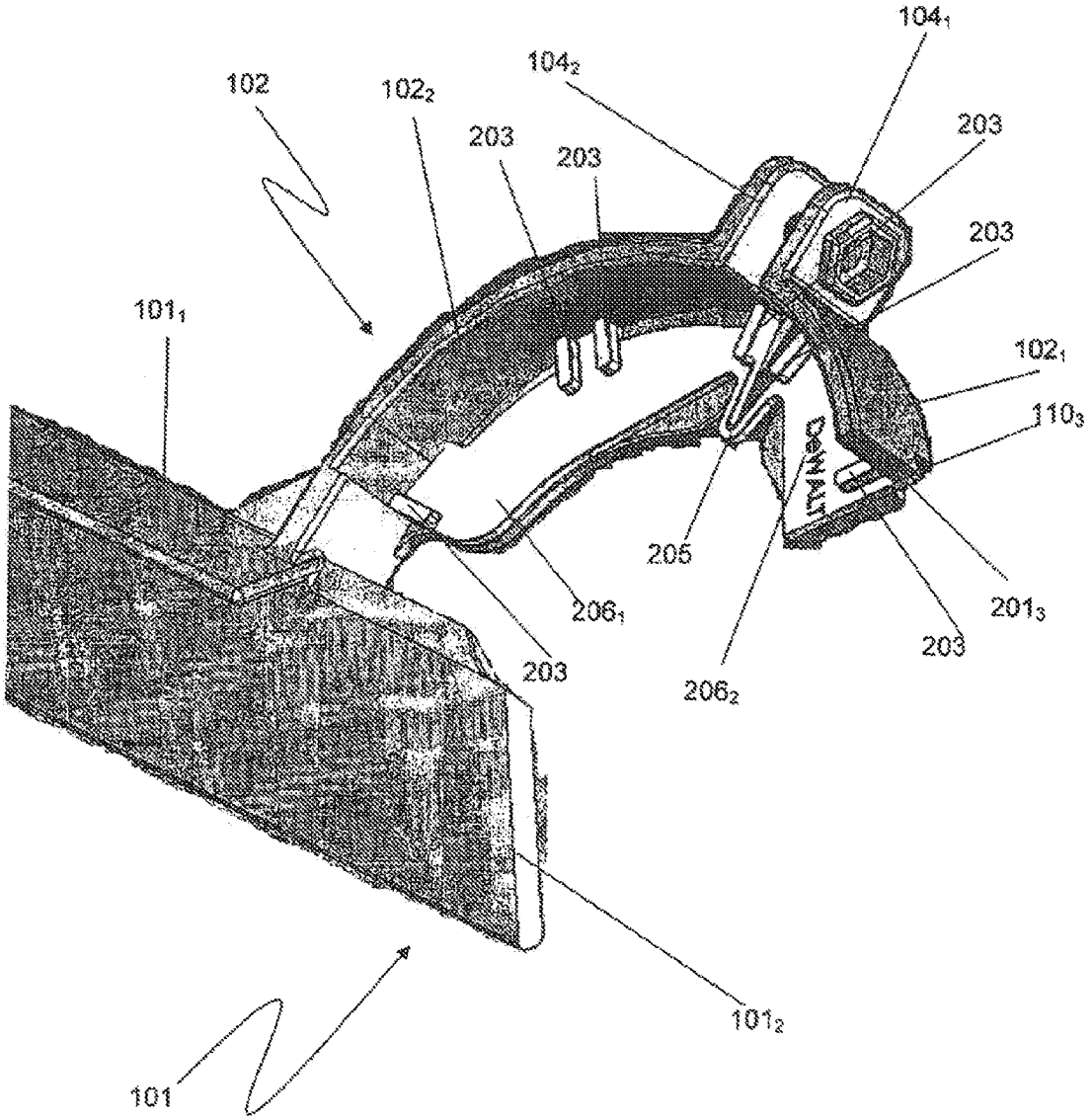
Figure 10:
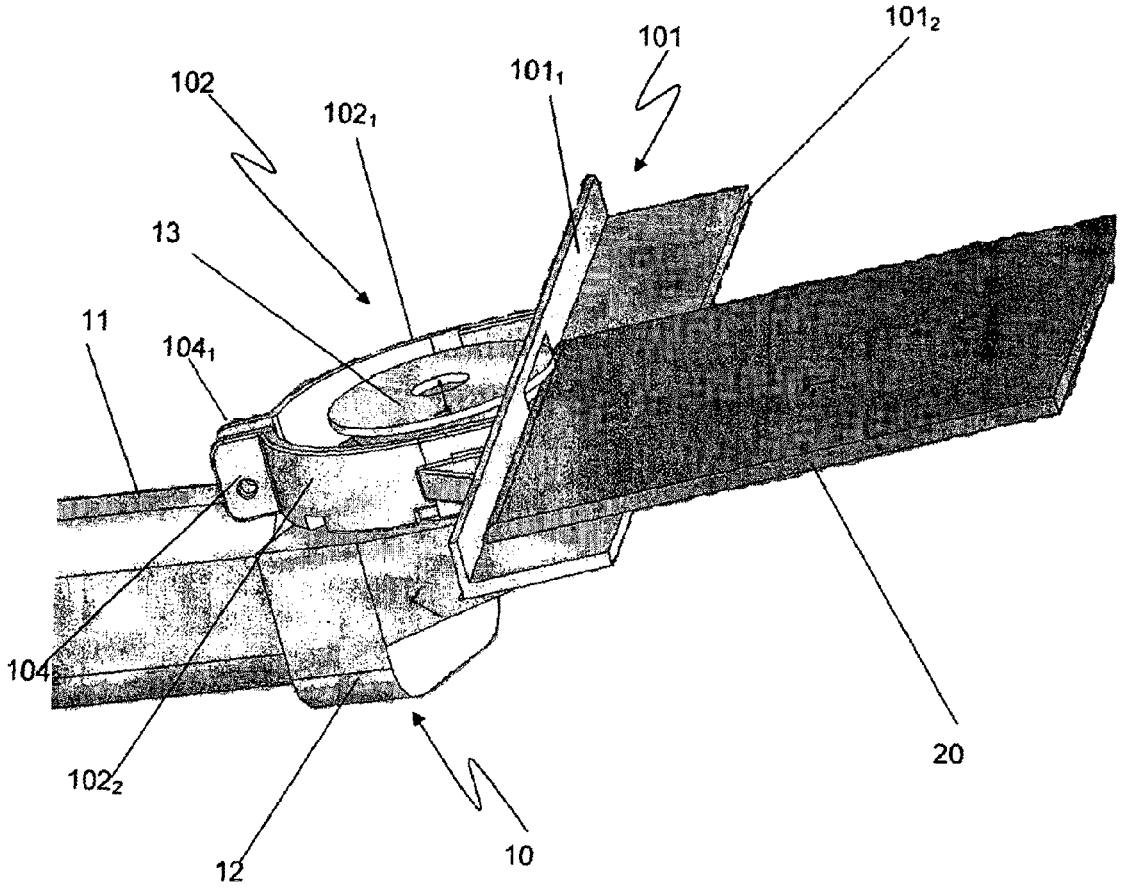
Figure 11:
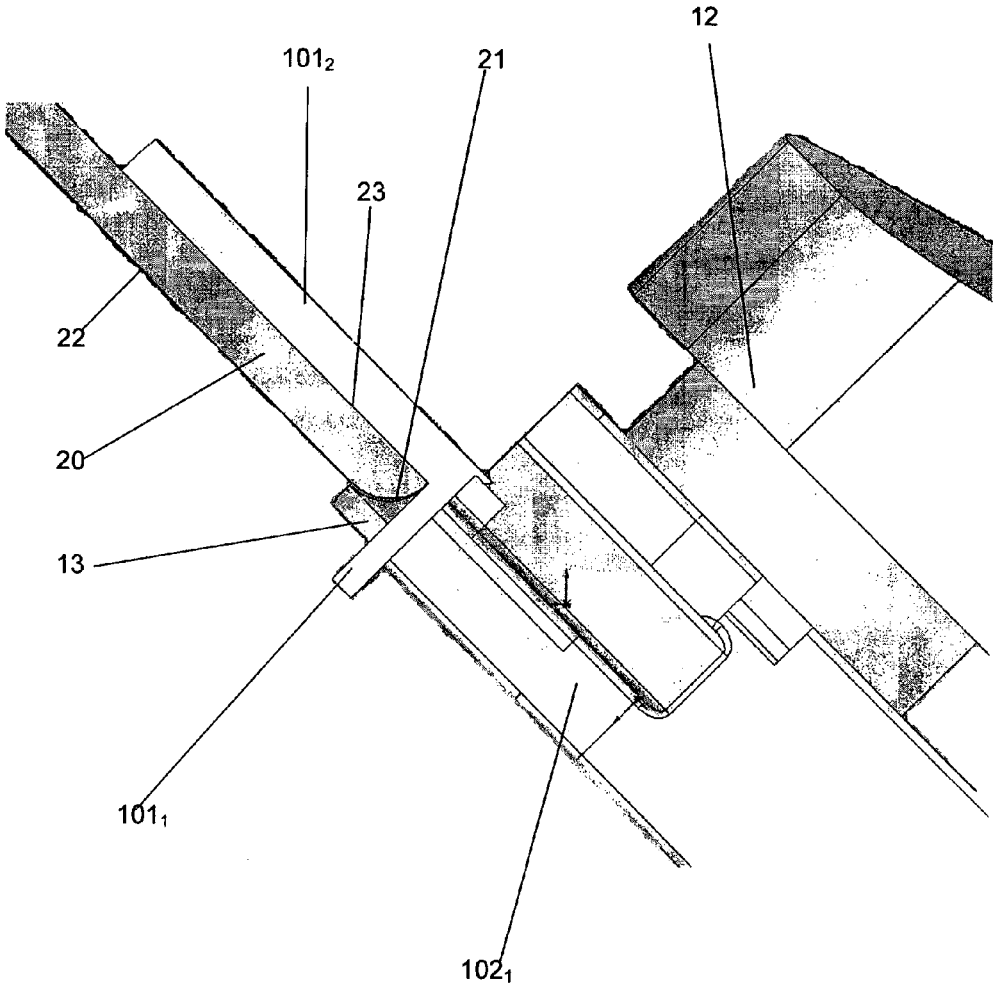

FIG. 5 a schematic view of a profiling tool attached to a grinder according to one embodiment of the present invention FIG. 6 is a side perspective view of the profiling tool of FIG. 5 in situ;

FIG. 7 is a perspective view of a profiling tool according to one embodiment of the present invention;

FIGS. 8A to 8C depict examples of a various spacers for use with the profiling tool of FIG. 7;

FIG. 9 is a partial sectional view depicting the positioning of a spacer within the profiling device of FIG. 7;

FIG. 10 is a schematic view of a profiling tool mounted in situ according to one embodiment of the present invention;

FIG. 11 is a side view of the profiling tool of FIG. 10.

DESCRIPTION OF EMBODIMENTS OF THE INVENTION

Figure 1:
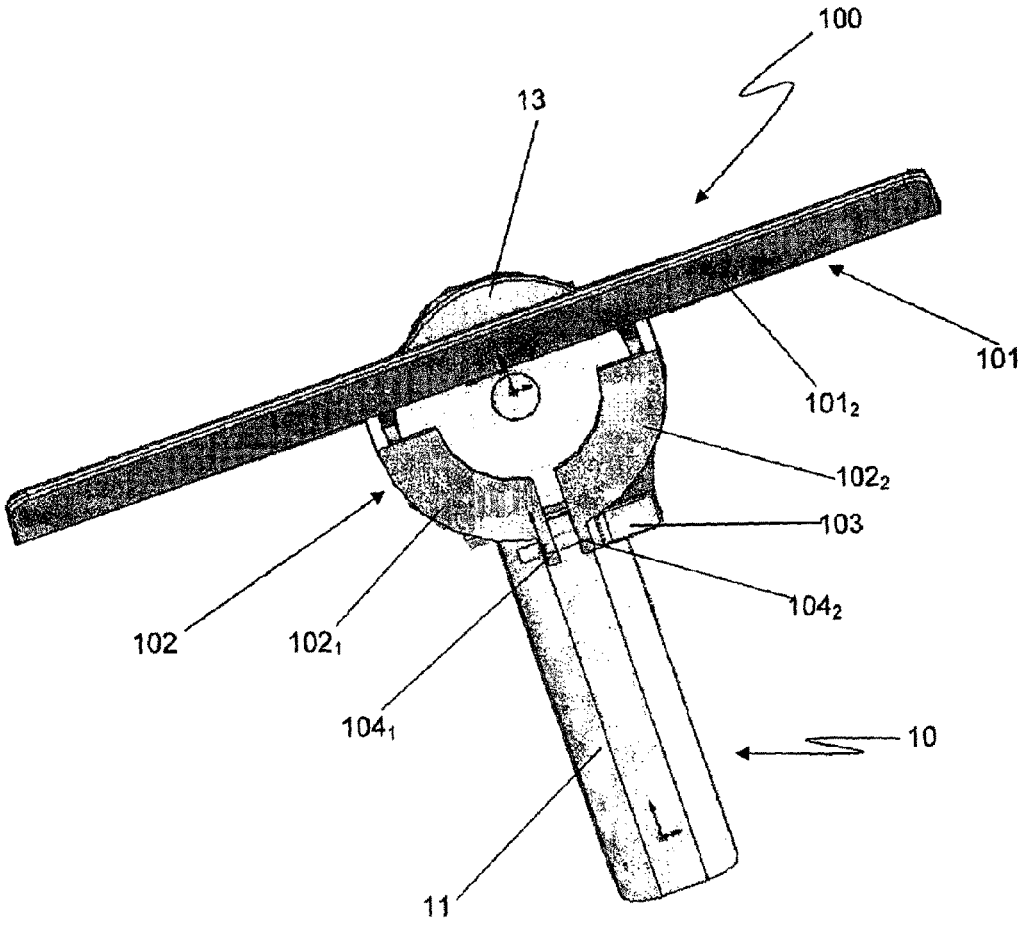
FIG. 1 is a schematic view of a profiling tool mounted in situ according to one embodiment of the present invention.

With reference to FIG. 1 there is illustrated a profiling device 100 according to one embodiment of the present invention. The profiling device in this particular example is shown mounted in situ to a cutting implement more specifically an angle grinder 10 having body 11, head 12 (not shown), blade 13 and guard 14 (not shown). The profiling device 100 in this case includes an elongate member 101 which encapsulates a portion of the blade 13 and a shroud 102 which is secured to the head 12 end of the grinder 10.

The shroud 102 in this particular example includes two segments $\mathbf{102}_1$, $\mathbf{102}_2$ each of which is attached in a flexibly resilient manner to the elongate member 101 such that the segments have $\mathbf{102}_1$, $\mathbf{102}_2$ are capable of a degree movement relatively to one another. The opposing ends of the segments $\mathbf{102}_1$, $\mathbf{102}_2$ in this case include lugs $\mathbf{104}_1$, $\mathbf{104}_2$ for receipt of a retaining bolt 103 to secure the shroud 102 on the guard 14 of the grinder 10.

Figure 2:
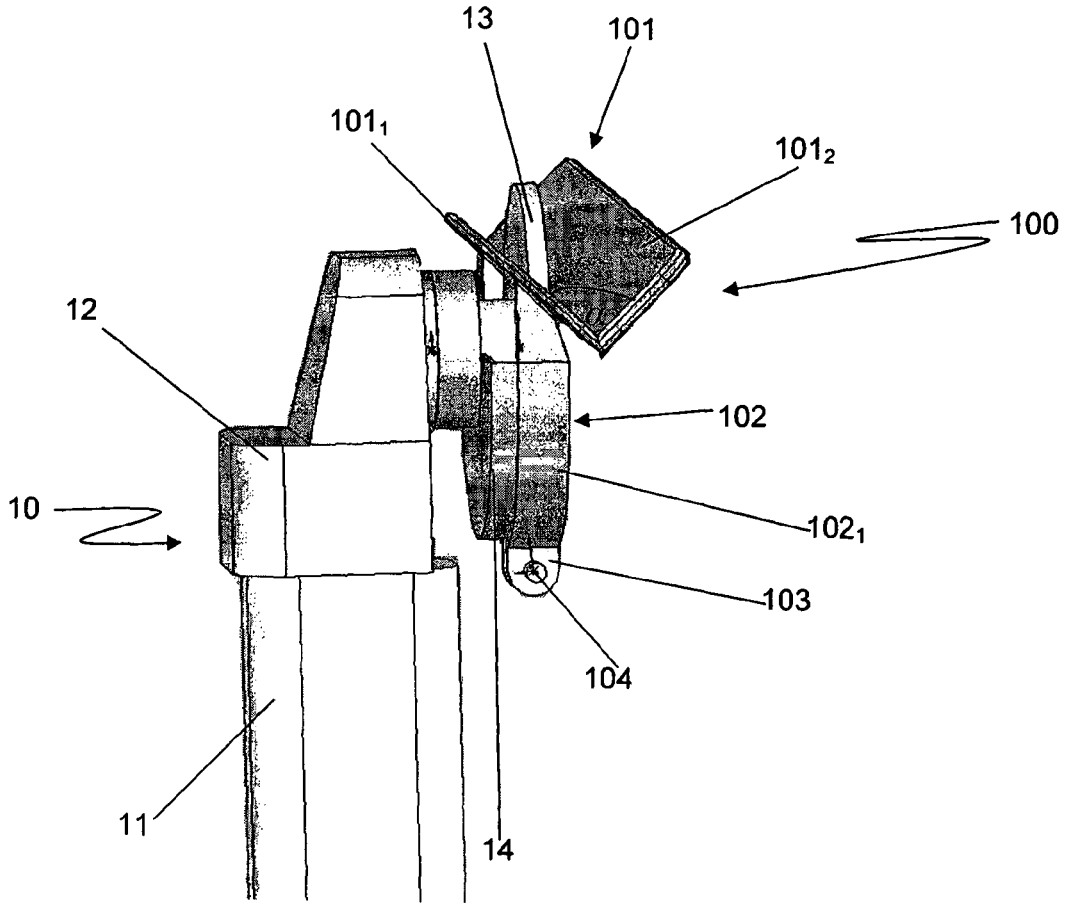
FIG. 2 is a side view of the profiling tool of FIG. 1 in situ.

FIG. 2 depicts the attachment of the profiling device 100 to the grinder 10 in further detail. The elongate member 101 includes rails $\mathbf{101}_1$, $\mathbf{101}_2$ the rails $\mathbf{101}_1$, $\mathbf{101}_2$ in this particular example are disposed at a preset angle $\alpha$ to one another. As can be seen in this view the elongate member 101 includes a slot for accepting a section of the cutting implement such as a grinding wheel or cutting blade. The slot being positioned about the mid point of the elongate member 101 and along the join between rails $\mathbf{101}_1$, $\mathbf{101}_2$. In order to secure the profiling to the head end 12 of the grinder a portion of the guard 14 is retained within the shroud 102.

As noted above the segments $\mathbf{102}_1$, $\mathbf{102}_2$ of the shroud 102 are attached in a flexibly resilient manner to the elongate member 101 and more specifically rail member $\mathbf{101}_2$, such that the segments have $\mathbf{102}_1$, $\mathbf{102}_2$ are capable of a degree movement relatively to one another. This movement between the segments $\mathbf{101}_1$, $\mathbf{101}_2$ enables the shroud 102 to be positioned over the guard 14 simply by drawing the segments away from one another thereby widening the gap therebetween allowing the shroud 102 to be fitted over the guard 14. Once in position the segments $\mathbf{101}_1$, $\mathbf{101}_2$ are released allowing them to spring back to their initial position causing the segments $\mathbf{101}_1$, $\mathbf{101}_2$ to grip the guard 14. To further secure the shroud 102 to the guard fastening bolt 103 is inserted through lugs $\mathbf{104}_1$, $\mathbf{104}_2$ the bolt 103 is then tightened to draw the segments $\mathbf{102}_1$, $\mathbf{102}_2$ together thereby closing the gap between the segments so that the clamp tightly against the guard 14. As will be appreciated by those of skill in the art the tightening of the bolt 103 could be effected in a number of ways for example the bolt could be engaged with a nut positioned on the outer surface of one of the lug $\mathbf{104}_1$, $\mathbf{104}_2$. Alternatively tightening of the bolt could be effected via thread engagement with the lugs $\mathbf{104}_1$, $\mathbf{104}_2$.

Figure 3:
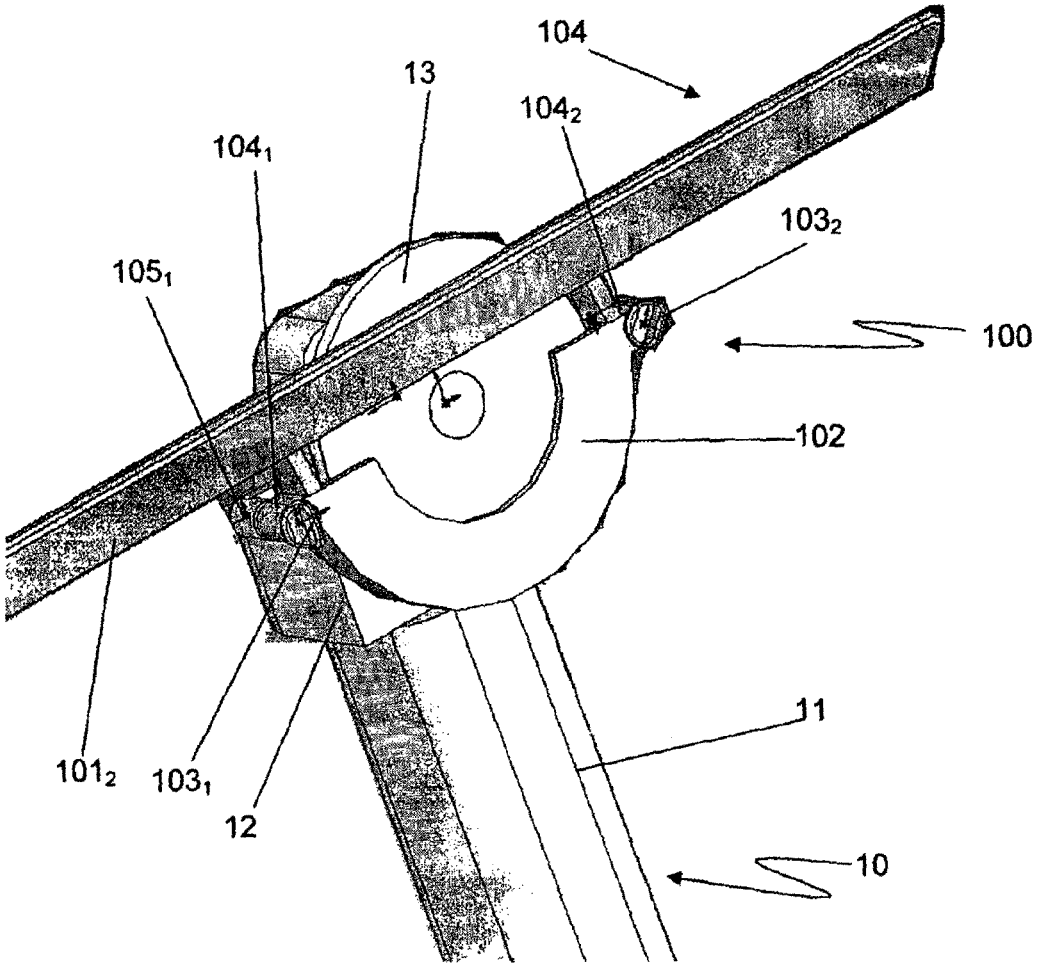
FIG. 3 is a schematic view of a profiling tool attached to a grinder according to one embodiment of the present invention.

FIG. 3 depicts the configuration of a profiling device 100 according to one embodiment of the present invention mounted in situ to a cutting implement more specifically an angle grinder 10 having body 11 , head 12, blade 13 and guard 14 (not shown). As with the above case the profiling tool 100 in this instance includes an elongate member 101 constructed from a pair of rails $\mathbf{101}_1$, $\mathbf{101}_2$ (not shown) attached to a shroud 102 secured to the guard 14.

Unlike the previous example however the shroud 102 is not a two piece construction. Rather the shroud 102 in this instance includes a single unitary arcuate member $\mathbf{102}_1$ which attaches to the guard 14 via the use of clamps $\mathbf{105}_1$, $\mathbf{105}_2$ (not shown) which are secured to the guard and shroud 102 via the engagement of retaining bolts $\mathbf{103}_1$, $\mathbf{103}_2$ which are inserted through diametrically opposed lugs $\mathbf{104}_1$, $\mathbf{104}_2$ on shroud 102.

Figure 4:
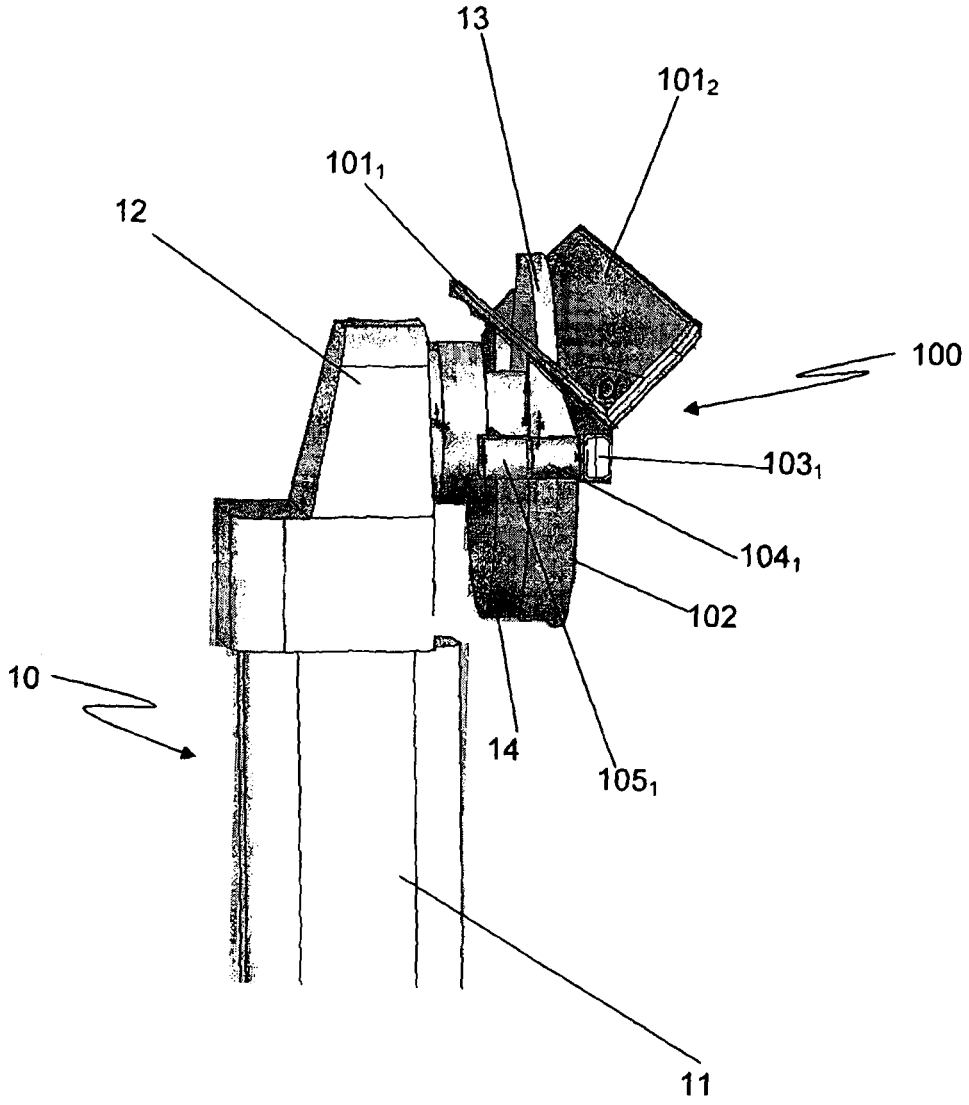
FIG. 4 is a side view of the profiling tool of FIG. 3 in situ.

Further details of the attachment of the profiling device 100 to the grinder 10 are shown in FIG. 4. As in the case of the above examples the shroud 102 is positioned such that a portion of the guard is retained therein. Again blade 13 extends through the slot provided in the elongate member and into the space formed by the angle $\alpha$ between rails $\mathbf{101}_1$, $\mathbf{101}_2$. Clamps 1051, 1052 (not shown) in this example include a substantially cylindrical body with a bore for receipt of the retaining bolts 103$_1$, 103$_2$. The clamps 105$_1$, 105$_2$ (not shown) also include a plate extending outwardly from the body for engagement with the rear surface of the guard 14.

In the example depicted in FIGS. 3 and 4 the shroud 102 could be positioned over the guard 14 in a number of ways for example the slot for accommodating the blade 13 could extend a predetermined distance into rail 101$_1$. To fit the profiling device the grinder 10 the blade is inserted into the slot at an angle such that a portion of the blade 13 contacts the upper and lower edges of the slot. Positioning the blade 13 in this manner angles the guard 14 away from the shroud 102. As the blade 13 is passed into the slot the body 11 of the grinder 11 is angled downwardly tiling the blade upwardly within the slot drawing the guard 14 into contact with the shroud 102. Once the guard 14 is in position within the shroud 102 the two are secured together via insertion of the retaining bolts 103$_1$, 103$_2$ through lugs 104$_1$, 104$_2$ into clamps 105$_1$, 105$_2$ causing the plates of the clamp to bite against the rear surface of the guard 14.

With reference to FIG. 5 there is illustrated a further configuration of the profiling device 100 according to one embodiment of the present invention, shown here mounted in situ to a cutting implement more specifically an angle grinder 10 having body 11, head 12, blade 13 and guard 14. The profiling device 100 in this case includes an elongate member 101 which includes a pair of rails 101$_1$, 101$_2$ disposed at an angle α to one another, the elongate member 101 encapsulating a portion of the blade 13. The profiling device 100 again includes a shroud 102 including a single unitary arcuate member 102$_1$ which attaches to the guard 14 via the use of clamps 105$_1$, 105$_2$ which are coupled to rail 1011 via bosses 1061, 1062.

FIG. 6 depicts the attachment of the profiling device of FIG. 5 to the grinder 10 in further detail. As shown clamps 105$_1$, 105$_2$ in this case are substantially U shaped members which engage the rear surface of the guard 14 and a portion of the front face of the shroud 102 (see FIG. 5). The clamps in this case are pivotal mounted at one end within bosses 106$_1$, 106$_2$ which inturn coupled the clamps to rail 101$_1$ of the elongate member.

To secure the profiling device 100 to the grinder the clamps 105$_1$, 105$_2$ are pivoted on the pivot mounting within the bosses toward the elongate member 101. Blade 13 is then inserted into the slot provided within the elongate member 101 bringing shroud 102 into engagement with the guard 14. Once a portion of the guard 14 is positioned within the shroud the clamps 1051, 1052 are pivoted back toward the grinder's head 12 such that they firmly grip the guard 14 and shroud 102 locking them together.

In the above examples the elongate member is constructed from rails 101$_1$,101$_2$ which are disposed at an angle α to one another, as will be appreciated by those of skill in the are the angle between the rails 101$_1$, 101$_2$ defines the cutting angle of the blade to the surface of the item to be cut. In the depicted examples the angular relation between the rails is fixed, i.e. several version of the elongate member are available for cutting standard angles such as bevels (i.e. α set to angels between 5° to 20°), mitres (α set to 45°). In one embodiment of the present invention the attachment between the elongate member 101 and the shroud 102 may not be a fixed attachment as in the case of the above discussed examples. For instance where a number of elongate members 101 are required to perform various angular cuts the attachment of an elongate member 101 having the desired cutting angel to the shroud 102 could be via a snap lock fitting or screw fitting. Such a fitting would enable elongate member to be readily swapped over when required. Alternatively the rail 101$_2$ could be hinged mounted to rail 101$_1$, allowing the angle between the two rails to be adjusted utilising a guide secured to rail 101$_2$ which permits the movement of rail 101$_2$ between a number of discrete positions relative to rails 101$_1$.

With reference to FIG. 7 there is illustrated a further configuration of the profiling device 100 according to one embodiment of the present invention. The construction of the profiling device in this instance is similar to that discussed in relation to FIG. 1 above namely the device includes a shroud 102 constructed from two segments 102$_1$, 102$_2$ each of which is attached in a flexibly resilient manner to the elongate member 101 such that the segments have 102$_1$, 102$_2$ are capable of a degree movement relatively to one another. The opposing ends of the segments 102$_1$, 102$_2$ in this case include lugs 104$_1$, 104$_2$ for receipt of a retaining bolt 103 (not shown) to secure the shroud 102 on the guard 14 of the grinder 10. Again the elongate member 101 includes rails 101$_1$, 101$_2$ disposed at a preset angle α to one another.

The sections of the shroud 102 in this case include a series of cut outs 110$_1$, 110$_2$, 110$_3$, 110$_4$ (not shown). The cut outs 110$_1$, 110$_2$, 110$_3$, 110$_4$ (not shown) are for receipt of a portion of spacer 200. A number of examples of spacers for use with the profiling device 100 of FIG. 7 are shown in FIGS. 8A to 8C. FIG. 8A depicts a spacer 200 for use with the profiling tool 100 when attached to a particular DeWALT grinder more specifically an 803 series grinder.

As shown the spacer 200 has a generally semicircular shape with a series of flanges 201$_1$, 201$_2$, 201$_3$, 204$_4$ extending outwardly at discrete points on the outer periphery of the spacer. The flanges include shoulder portions in the case the shoulder portions 202 are formed from a set of projections 203 extending from the face 204 of the spacer 200. The projections 203 also act to provided proper spacing between the guard 12 of the grinder and the profiling device to position the blade within the slot provided within the elongate member 101.

The spacer 200 in this case also includes a spring in the form of a compressible structure 205 in the form of a compressible V disposed at the apex of the spacer. The compressible V 205 is effectively a bridging mechanism joining arms 2061, 2062 of the spacer 200. When the shroud 102 is tightened by drawing the two segments 102$_1$, 102$_2$ together the V 205 compresses allowing the arms 206$_1$, 206$_2$ to match the moment of the segments to which they are attached. In addition the arms 206$_1$, 206$_2$ are specifically shaped to suit the rear of the guard of the specific grinder.

FIG. 8B depicts the arrangement of a spacer 200 for use with a Makita grinder and more specifically a 9553 series of grinder. The construction of the spacer 200 in this case is similar to that of the spacer of FIG. 8A. Namely the spacer 200 includes arms 206$_1$, 206$_2$ connected via a compressible structure 205. Again the spacer 200 is of a generally semicircular construction with a series of flanges 201$_1$, 201$_2$, 201$_3$, 204$_4$ extending outwardly at discrete points on the outer periphery of the spacer. The flanges include shoulder portions in the case the shoulder portions 202 are formed from a set of projections 203 extending from the face 204 of the spacer 200.

A spacer 200 for use with a Bosch grinder more specifically the GWS 7-100 series of grinders is shown in FIG. 8C. As in the above cases the spacer 200 includes arms 206$_1$, 206$_2$ connected via a compressible structure 205. Again the spacer 200 is of a generally semicircular construction with a series of flanges 201$_1$, 201$_2$, 201$_3$, 204$_4$ extending outwardly at discrete points on the outer periphery of the spacer. The flanges include shoulder portions in the case the shoulder portions 202. However in this instance the spacer 200 includes two projections 203 from the face 204 of the spacer 200. The projection 203 in this case are position adjacent the base of the arms $\mathbf{206}_1$, $\mathbf{206}_2$ and are of a significantly larger size than those of the spacers shown in FIGS. 8A and 8C.

FIG. 9 depicts the positioning of the spacer 200 within the shroud 102. In this instance the spacer is of the type shown in FIG. 8A. As shown the spacer is positioned within the shroud 102 such that arms $\mathbf{206}_1$, $\mathbf{206}_2$ with the compressible structure 205 positioned adjacent the gap provided between the lugs 1041, 1042 and the segments $\mathbf{102}_1$, $\mathbf{102}_2$. The flanges $\mathbf{201}_1$, $\mathbf{201}_2$, $\mathbf{201}_3$, $\mathbf{204}_4$ are positioned within their respective cut out $\mathbf{110}_1$, $\mathbf{110}_2$, $\mathbf{110}_3$, $\mathbf{110}_4$ such that the shoulder portions abut the interior edge of the shroud 102. When the spacer 200 is positioned in this manner the projections 203 extend into the interior of the shroud 102, when the guard of the grinder is positioned within the interior of the shroud it abuts the upper surface of the projections ensuring that the blade is properly positioned within the slot between the rails $\mathbf{101}_1$, $\mathbf{101}_2$ of the elongate member 101.

With reference to FIGS. 10 and 11 there is illustrated a profiling device 100 according to one embodiment of the present invention. In this example the profiling device 100 is design to round the edge of the title to create what is knows as a bull nose. As shown the profiling device in this particular example is of a similar construction to that discussed above in relation to FIGS. 1 and 2. The profiling device 100 in this case includes an elongate member 101 which encapsulates a portion of the blade 13 and a shroud 102 which is secured to the head 12 end of the grinder 10 and about the guard 14.

The shroud 102 in this particular example includes two segments $\mathbf{102}_1$, $\mathbf{102}_2$ each of which is attached in a flexibly resilient manner to the elongate member 101 such that the segments have $\mathbf{102}_1$, $\mathbf{102}_2$ are capable of a degree movement relatively to one another. The opposing ends of the segments $\mathbf{102}_1$, $\mathbf{102}_2$ in this case include lugs $\mathbf{104}_1$, $\mathbf{104}_2$ for receipt of a retaining bolt 103 to secure the shroud 102 on the guard 14 of the grinder 10.

In this case the slot through which the blade 13 extends is provided in rail $\mathbf{101}_1$ a present distance from the join between the rails. As can be seen form FIGS. 10 and 11 the tile 20 is placed on rail $\mathbf{102}_2$ with the upper face 22 of the tile facing the rear surface of the blade 13 (i.e. the face of the tile forming finished surface is positioned toward the rear face of the blade 13). In order to round the edge 21 of title 20, the tile 20 is manoeuvred laterally across the rail $\mathbf{101}_2$ with the vertex formed between the lower face 23 and edge 21 abutting rail $\mathbf{101}_1$. As can be seen in this instance the rail members 1011 and 1012 are disposed at sustainably 90° to each other.

As can be seen in this example the rear face of the blade 13 is used to hone the former of the edge 21 of the tile 20 based on its position with respect to rail member $\mathbf{101}_2$. While in this example the blade is disposed at a pre-set distance from the rail member $\mathbf{101}_2$ , it will of course be appreciated by those of skill in the art that the distance between the blade 13 and rail $\mathbf{101}_2$ may be adjusted to accommodate different tile thickness by moment of rail $\mathbf{101}_1$ relative to the blade 13.

It is to be understood that the above embodiments have been provided only by way of exemplification of this invention, and that further modifications and improvements thereto, as would be apparent to persons skilled in the relevant art, are deemed to fall within the broad scope and ambit of the present invention described herein.

The invention claimed is:

1. A profiling device for attachment to a cutting device, the cutting device including a cutting implement and a cutting guard surrounding a portion of the cutting implement, the profiling device including:

an elongate member adapted to accommodate a portion of the cutting implement said elongate member including first and second rail members wherein the first rail member is angularly disposed to the second rail member;

a shroud coupled to the elongate member for attachment to the cutting device;

wherein the shroud is secured to the cutting device adjacent the cutting implement such that a portion of the cutting guard is retained within the shroud.

2. The profiling device of claim 1 wherein the shroud is clamped to the cutting device.

3. The profiling device of claim 2 wherein the shroud is clamped on a portion of the cutting device's cutting guard.

4. The profiling device of claim 3 wherein the shroud is a two piece construction.

5. The profiling device of claim 4 wherein the shroud includes a pair of segments for engagement with the cutting guard and wherein the shroud is clamped to the cutting guard by drawing adjacent ends of the segments of the shroud together.

6. The profiling device of claim 3 wherein the shroud is a unitary body and wherein the shroud is clamped to the cutting guard by a pair of clamping members.

7. The profiling device of claim 6 wherein the clamping members are secured to the shroud via threaded engagement.

8. The profiling device of claim 7 wherein the shroud is of a semicircular construction and wherein the clamping members are diametrically opposed.

9. The profiling device of claim 7 wherein the clamping members have a substantially L shaped cross section.

10. The profiling device of claim 6 wherein the clamping members are pivotally mounted on the elongate member whereby the clamping members being movable between a locked and open position.

11. The profiling device of claim 10 wherein the clamping members engage a portion of the shroud and cutting guard in the locked position.

12. The profiling device of claim 10 wherein the clamping members are substantially U shaped.

13. The profiling device of claim 1 wherein the first rail member is disposed at an angle between 10° to 15° to the second rail member.

14. The profiling device of claim 1 wherein the first rail member is disposed at an angle of 45° to the second rail member.

15. The profiling device claim 1 wherein the first rail member is disposed at an angle between 20° to 30° to the second rail member.

16. The profiling device of claim 1 wherein the first rail member is disposed at an angle between 5° to 10° to the second rail member.

17. The profiling device of claim 1 wherein the first rail member is disposed at an angle of 90° to the second rail member.

18. The profiling device of claim 1 wherein the elongate member includes a slot for accommodating the portion of the cutting implement, said slot being disposed adjacent the join between the first and second rail members.

19. The profiling device of claim 5 wherein the segments of the shroud are drawn together via a fastener inserted through lugs positioned on the outer periphery of each segment.

20. The profiling device of claim 1 wherein the elongate member is removably secured to the shroud.

21. The profiling device of claim 20 wherein the elongate member is removable secured to the shroud via a snap lock fitting.

22. The profiling device of claim 1 wherein the first rail member is pivotally mounted to the second rail member permitting the first rail member to be positioned at a number of discrete angular positions relative to the second rail.

23. The profiling device of claim 17 wherein the first rail member includes a slot for accommodating a portion of the cutting implement and wherein the position of the cutting implement within the slot is adjustable.

* * * * *